US005279205A

United States Patent [19]

Carlson, Jr. et al.

[11] Patent Number: 5,279,205

[45] Date of Patent: Jan. 18, 1994

[54] AXIAL PISTON FLUID TRANSLATING UNIT WITH SEALED BARREL PLATE

[75] Inventors: Guy C. Carlson, Jr., Minooka; William K. Engel; Robert J. Huebner, both of Peoria; Donald H. Sherman, Morton, all of Ill.

[73] Assignee: Caterpillar Inc., Peoria, Ill.

[21] Appl. No.: 990,969

[22] Filed: Dec. 15, 1992

Related U.S. Application Data

[63] Continuation-in-part of Ser. No. 821,420, Jan. 15, 1992, abandoned.

[51] Int. Cl.[5] ..... F01B 13/00

[52] U.S. Cl. ..... 91/485; 91/499

[58] Field of Search ..... 91/485, 499, 6.5, 487, 91/504

[56] References Cited

U.S. PATENT DOCUMENTS

| | | | |
|---|---|---|---|
| 3,479,963 | 11/1969 | Randa | 91/485 |
| 3,618,471 | 11/1971 | Hein | 91/485 |
| 3,808,950 | 5/1974 | Davies | 91/487 |
| 4,007,663 | 2/1977 | Nagatomo | 91/6.5 |
| 4,201,117 | 5/1980 | Gherner | 91/499 |
| 4,437,389 | 3/1984 | Kline | 91/499 |
| 4,481,867 | 11/1984 | Nagase et al. | 91/487 |

OTHER PUBLICATIONS

Application Ser. No. 07/821,421 filed Jan. 15, 1992 Title: A Seal Ring With Attached Biasing Means. Inventor: William K. Engel.

*Primary Examiner*—Edward K. Look
*Assistant Examiner*—Peter Korytnyk
*Attorney, Agent, or Firm*—Loyal O. Watts; John W. Grant

[57] ABSTRACT

Axial piston fluid translating units commonly experience undesirable shaft deflections and barrel tilting during operation. A fluid translating unit includes a barrel plate interposed the end of a barrel and a porting surface defined within a housing thereof. The barrel plate is axially spaced from an end of the barrel and is in face sealing engagement with the porting surface. The barrel plate defines a plurality of fluid ports, each communicating between one of a plurality of barrel cylinder bores and the porting surface. In one aspect a plurality of counterbores are provided in the barrel in surrounding relation to the fluid ports. A plurality of seal rings having a sealing end defining an annular seal face of a predetermined width for face sealing engagement with the barrel plate. The seal rings are each disposed in one of the counterbores in circumferential sealing relation of a predetermined length which is no greater than the width of the sealing face. A plurality of annular springs are disposed in the counterbores for urging the seal rings into sealing engagement with the other of the barrel and the barrel plate. This arrangement permits tilting of the barrel without damaging contact or excessive leakage between the barrel plate and the porting surface.

11 Claims, 5 Drawing Sheets

AXIAL PISTON FLUID TRANSLATING UNIT WITH SEALED BARREL PLATE

DESCRIPTION

This is a continuation-in-part of application Ser. No. 07/821,420 filed on Jan. 15, 1992, now abandoned.

TECHNICAL FIELD

This invention relates generally to axial piston fluid translating units and more particularly to a barrel and barrel-plate structure for such fluid translating units.

BACKGROUND ART

It is common industry knowledge that the rotating barrel of an axial multiple piston fluid translating unit tends to move or tilt relative to a porting plate or a porting surface of the housing thereof. Such movement or tilting results from the pistons operating against an inclined cam plate as well as radial force components resulting from the pistons being in different planes.

Tilting of the barrel causes the barrel face to be inclined relative to the porting surface. This can result in undesirable fluid leakage and localized contact between the mating surfaces with resultant damage thereto.

These problems have been recognized in the prior art, and numerous solutions proposed therefor. Once such proposed solution is disclosed in U.S. Pat. No. 3,808,950. This patent discloses a pump barrel having a port plate rotatable therewith against a valve plate with a sleeve extending into counterbores in both the barrel and the port plate and a separate O-ring seal associated with each end of the sleeve and its respective counterbore. This system also includes separate washers disposed at each end of the sleeve in the respective counterbores to compress the O-ring seals and provide an axial thrust force urging the port plate into contact with the valve plate. This results in an unnecessarily complicated and expensive design requiring the providing of recesses at each end of the sleeve to receive the O-rings. It is also necessary to provide counterbores in both the piston barrel and the port plate rotatable therewith to receive the opposite ends of the sleeve and the seals. Additionally, it is necessary to provide washers in each of the counterbores at the opposite end of the sleeve to compress the O-rings and to provide a thrust force of the port plate against the valve plate. This system also provides undesirable stiffness in the relationship of the barrel to the port plate due to engagement of the sleeve with the counterbores in each of those elements and could result in tilting forces being transferred from the barrel to the port plate. Provision of sufficient clearance around the sleeve to avoid or minimize such tilting force transfer could result in failure of the seals due to extrusion of those seals into the annular clearance around the sleeve by the extremely high pressures encountered in a piston pump of this general type. It is therefore apparent that such a system is highly undesirable, not only from an economic standpoint but, also from the high risk that the system will not operate to provide the intended freedom and/or early failure of the system due to blowout of the seals.

U.S. Pat. No. 4,007,663 discloses another proposed solution to the problem of barrel tilting in a hydraulic translating unit. This patent teaches a system in which a flanged slipper pad includes a cylindrical end engaging each of the cylinder bores in the rotating barrel and a flanged end engaging a port plate secured to the housing or head of the pump or motor. An annular plate defines a series of openings therein telescoped over the flanged sleeves underneath said flanges and utilizes a series of springs between the annular plate and the end of the barrel for urging the flanged ends of the sleeves against the port plate for sealing purposes. Since the port plate is secured to the housing or head of the pump and the slipper pads are telescopically engaged in the outer ends of the cylinder bores in the barrel, rotation of the barrel may causes a tendency for the slipper pads to tilt in the cylinder bores which could cause leakage and undesirable contact of the slipper pads with the valve plate. This could also be further aggravated by tilting of the cylinder block. Due to the relatively lengthy engagement of the slipper pad with the cylinders, tilting of the cylinder block may cause further tilting of the slipper pads relative to the valve plate. This system is also complicated in that it involves many innerfitting small parts and therefore would be considered to be excessively expensive.

U.S. Pat. No. 4,481,867 discloses another proposed solution to the problem of the cylinder block tilting with the resultant undesirable effects. This patent teaches a seal plate disposed between the cylinder block and a valve plate for rotation with the barrel and in sliding contact with the valve plate. The plurality of cylinder bores in the cylinder block each contains a telescopically mounted bushing consisting of a thin-walled cylinder which can make tight contact with a inner wall surface of the bore as expanded in diameter by a high pressure liquid within the bore and the bushing. The other end of the bushing defines a flanged portion which is engaged against the seal plate and is urged into contact therewith by a compression coil spring and a plate positioned between the flanges of the bushings and the end surface of the cylinder block. This structure requires the provision of excessive space between the end of the barrel and the valve plate thus resulting in a larger overall unit and greater space requirements. The expansion of the bushings in the cylinder bores for sealing purposes could also severely restrict the ability of the bushings to move relative to the cylinder block thus creating undesirable motion of the bushings relative to the seal plate as the cylinder block tilts. This system would also be undesirably complicated and expensive to manufacture.

U.S. Pat. No. 4,201,117 teaches yet another proposed solution to the problem of barrel tilting relative to a porting surface within the pump or motor housing. In this system, a toroidal distributor, rotatable with the barrel, is disposed in sliding contact with a distribution flange. The toroidal distributor includes a series of spherical pockets on the side thereof facing the barrel for reception of the complimentary spherical ends of a plurality of cylindrical plugs telescopically engaging the cylinder bores in the pump barrel. The cylindrical plugs are secured to the toroidal distributor by thin-walled tubes extending through the openings therein and flanged at their opposite ends to retain the cylindrical plugs in sealing relation to the spherical surfaces of the toroidal distributor. The cylindrical plugs each define annular grooves around the outer periphery thereof for reception of sealing rings which engage the inner surface of the cylinder bores of the barrel. This system results in an undesirable length of engagement of the cylindrical plug within the cylinder bore which, unless adequate clearance is provided, may restrict motion of the barrel relative thereto, thus causing a disruption of the sealing relationship of the peripheral surfaces on the cylindrical plug and the toroidal distributor. This system is also undesirably complex and expensive to manufacture due to the various parts thereof and the required precision machining of the spherical sealing surfaces on both the cylindrical plugs and the toroidal distributor.

In view of the undesirable aspects of the above described prior art systems, it is highly desirable that means be provided for simply and effectively compensating for tipping of the barrel within an axial piston fluid translating unit without affecting or disrupting the close tolerance, running seal between the outer end of a barrel plate and the porting surface of such translating units. It is also desirable that the sealing means between the barrel and the barrel plate be axially compact to minimize the physical size of the fluid translating unit. It is also desirable that the length of the flow path from the end of the barrel to the porting plate be as short as possible to minimize the volume of fluid residing therein.

The present invention is directed to overcoming one or more of the problems as set forth above.

DISCLOSURE OF THE INVENTION

In one aspect of the present invention, an axial piston fluid translating unit includes a housing having an intake port and an output port each terminating at one end at a porting surface in the housing. A rotatable shaft extends into the housing and a cylinder barrel is disposed therein and supported for rotation with the shaft. The cylinder barrel includes a fluid intake-output end and defines a plurality of cylinder bores. A plurality of pistons are reciprocably disposed in the cylinder bores and the intake-output end of the barrel is disposed in proximate facing relation to the porting surface of the housing. An axially floating barrel plate is disposed between the housing porting surface and the intake-output end of the barrel and is connected for rotation with the barrel in axially spaced relation to the intake-output end thereof. The barrel plate includes a first annular surface in sealing engagement with the porting surface and a plurality of fluid ports each communicating between one of the cylinder bores and the housing porting surface for sequential communication with the intake and output ports. A plurality of counterbores are defined in one of the barrel and the barrel plate in generally surrounding relation to the fluid ports. Seal means are interposed the barrel and the barrel plate in sealing relation around each cylinder bore. The seal means includes a plurality of annular seal rings each having a sealing end defining an annular seal face having a predetermined width. The annular seal rings are disposed one in each of the counterbores in face sealing relation to the other of the barrel and the barrel plate. Means for urging the seal rings toward the other of the barrel and the barrel plate are disposed in the counterbores and comprises a resilient member dispose in the respective counterbores.

BEST MODE FOR CARRYING OUT THE INVENTION

Figure 1:
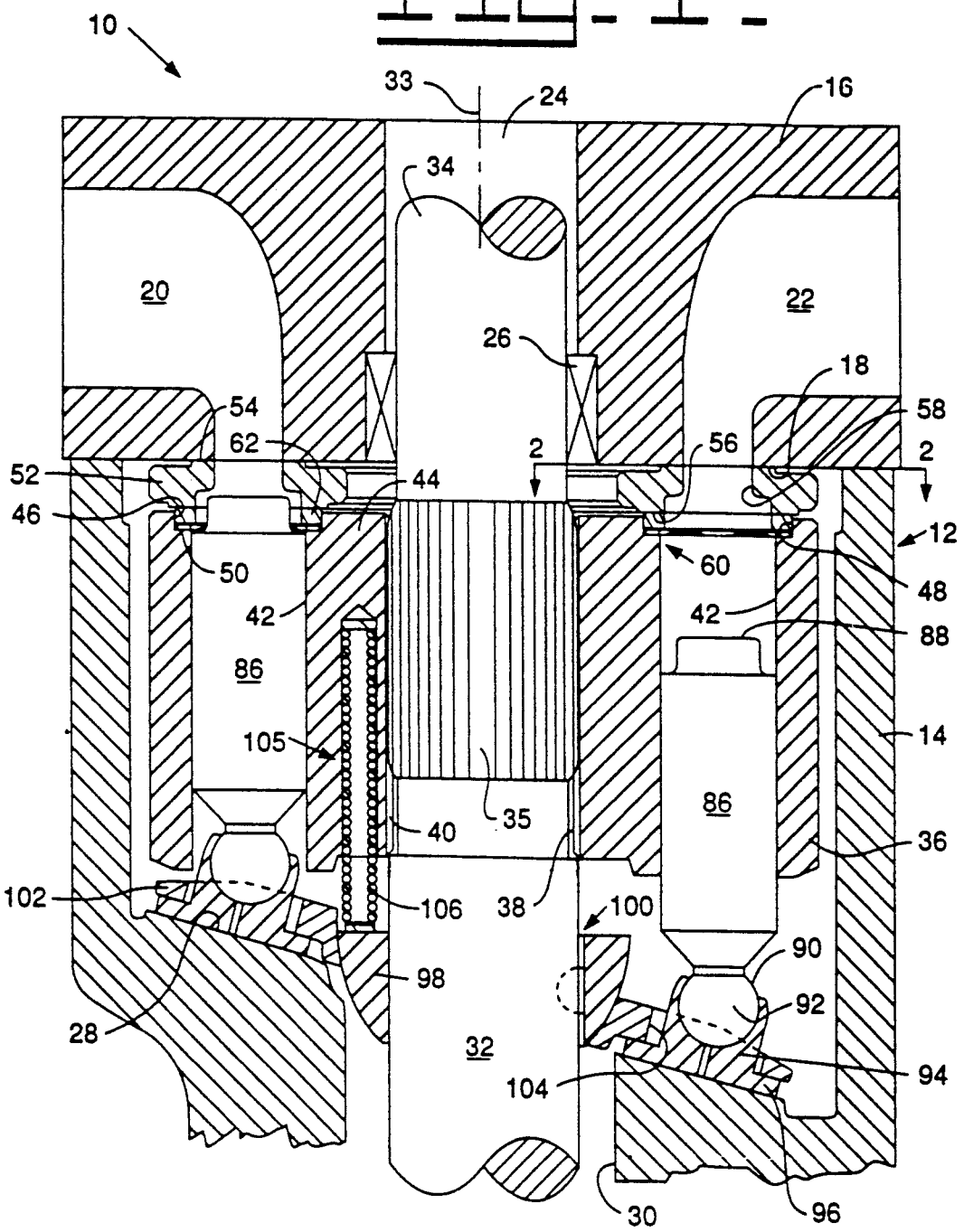
FIG. 1 is a cross sectional view of an axial piston fluid translating unit including an embodiment of the present invention.
Figure 2:
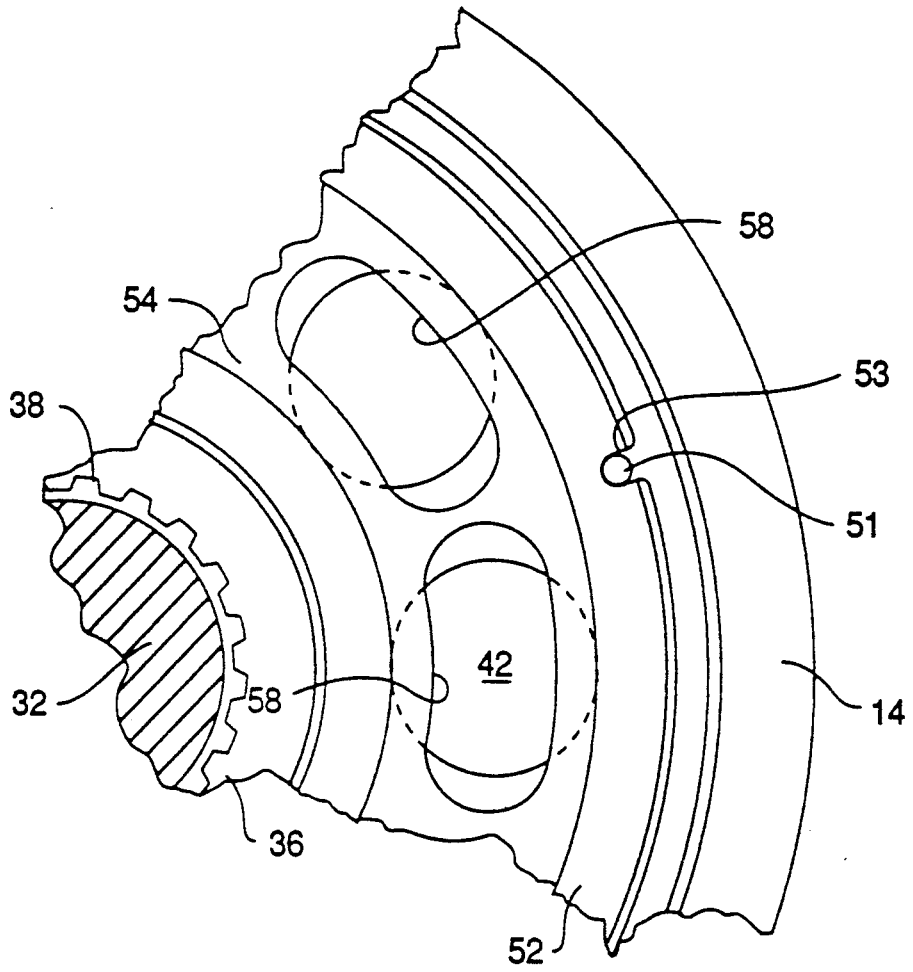
FIG. 2 is a view taken transversely of the axis of the fluid translating unit along the lines 2—2 of FIG. 1.
Figure 3:
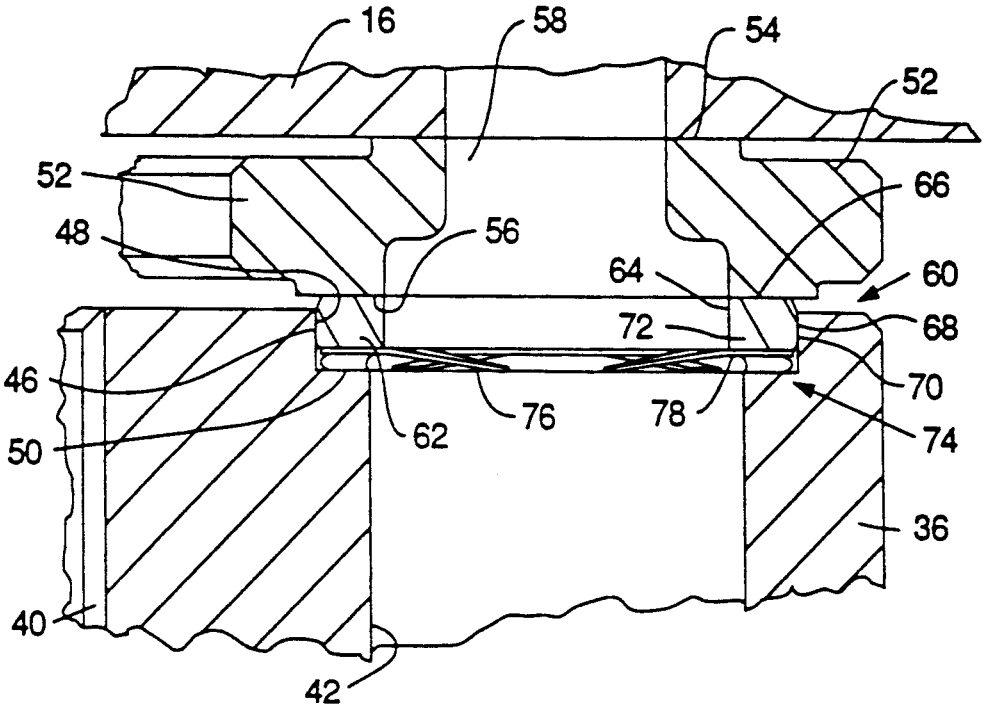
FIG. 3 is a fragmentary enlarged cross sectional view disclosing in greater detail the present invention as shown in FIG. 1.

Referring now to FIGS. 1, 2, and 3, a first embodiment of an axial piston fluid translating unit 10 is disclosed. The fluid translating unit 10 includes a multipart housing 12 having a body 14 and a head 16 removably attached thereto in any suitable manner. The head 16 includes a porting surface 18, an intake port 20, and an output port 22 each individually communicating with the porting surface 18. The intake port 20 and the output port 22 terminate at the porting surface in the form of arcuate slots (not shown in elevation) in a conventional manner. The head 16 also includes a bore 24 having a bearing 26, such as a roller bearing, mounted therein. Although the bore 24 is shown as extending through the head 16 to permit power beyond the bore could also be a blind bore as is conventional in the relevant art.

The body 14 of the housing 12 defines an inclined cam surface 28 therein at an end opposite the head, for purposes which will be described hereinafter. The fluid translating unit shown is a fixed displacement unit since the cam surface 28 is fixed to the housing 12. It is recognized, however, that the cam surface may be associated with a pivotable swash plate in a variable displacement fluid translating unit. The body 14 also includes a bore 30 at the end opposite to the head 16.

A shaft 32 having an axis 33 extends into the housing 12 by way of the bore 30 and has its opposite end 34 rotatably engaged in the sleeve bearing 26, for support thereof within the housing. The shaft 32 includes a splined portion 35 disposed intermediate the head 16 and the bore 30 for purposes to be hereinafter explained.

A barrel 36 is disposed within the housing 12 in concentric aligned relation with the axis 33 of the shaft 32 and includes a central bore 38 defining an internal spline 40 adapted for engagement with the splined portion 35 of the shaft 32. The barrel also includes a plurality of cylinder bores 42 which may be of any suitable number, however, in this particular embodiment nine (9) of the cylinder bores 42 are provided in angularly, equally spaced, concentric arrangement around the central bore 38. The barrel 36 further includes an intake-output end 44 disposed in proximate facing relationship to the porting surface 18 of the housing 12. A plurality of counterbores 46, equal in number to the cylinder bores 42, are provided in the intake-output end of the barrel in concentric relation to the cylinder bores 42. The counterbores 46 define, with the barrel 36, an inner peripheral surface 48 and an axially facing shoulder 50. A dowel 51, see FIG. 2, secured to the barrel extends outwardly from the intake-output end thereof for the purposes later described.

An annular barrel plate 52 is disposed intermediate the porting surface 18 of the head 16 and the intake-output end 44 of the barrel 36. A notch 53 or other suitable opening is defined in the barrel plate for engagement with the dowel 51 to connect the barrel plate to the barrel 36 for rotation therewith. The barrel plate 52 includes a first annular surface 54 which is disposed in face sealing engagement with the porting surface and further includes a second annular surface 56 which is in facing, slightly spaced relation to the intake-output end of the barrel 36. The barrel plate 52 further includes a plurality of arcuate ports 58 generally aligned with and equal in number to the cylinder bores 42 and each communicating between one of the cylinder bores and the porting surface for sequential communication with the intake and output ports 20, 22.

Figure 4:
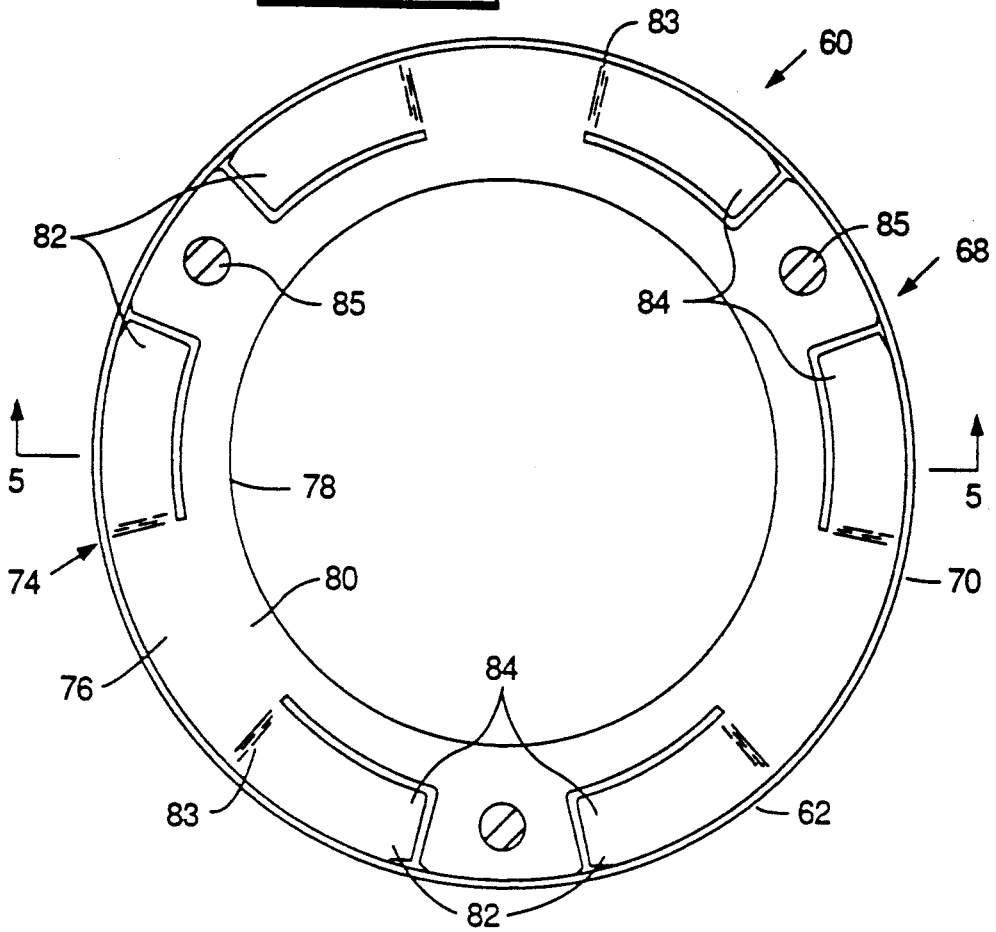
FIG. 4 is a plan view of a seal ring and spring ring as utilized in the present invention.
Figure 5:
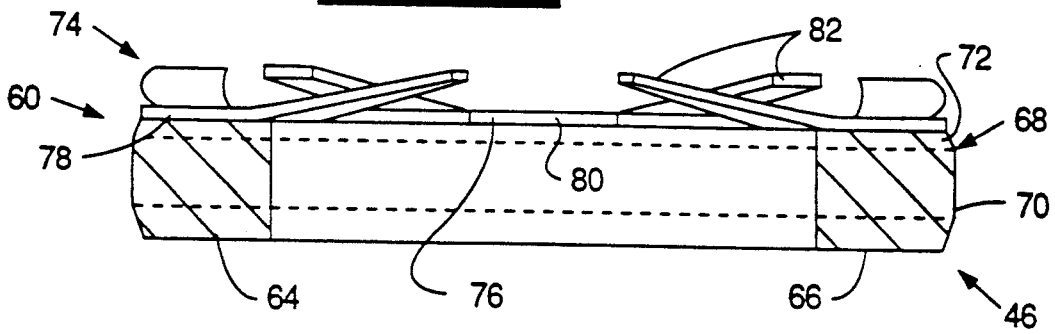
FIG. 5 is a partial cross sectional view of the seal ring of FIG. 4 with the spring ring shown in elevation.

A plurality of seal means 60 equal in number to the cylinder bores 42 are disposed in the counterbores 46 in the barrel. The seal means, as best shown in FIGS. 4 and 5, includes a plurality of annular seal rings 62 each having a sealing end 64 which defines an annular seal face 66 having a predetermined width which is, in one example, approximately 3.18 millimeters. The seal rings 62 each have a spherical outer periphery 68 which defines a circumferential sealing surface 70 which is disposed in circumferential sealing relation to the inner peripheral surface 48 of the counterbores 46. The circumferential sealing surface 70 of the seal rings has a sealing engagement with the inner peripheral surface 48 of the counterbores of a predetermined length which in this instance is essentially a line due to the spherical shape of the outer periphery thereof. It is also anticipated that the outer periphery 68 may also be cylindrical with the predetermined length of the circumferential sealing surface 70 being approximately 1.0 millimeter due to large chamfers being provided at each end of the seal ring. In this application, the predetermined length of sealing relation between the circumferential sealing surface and the counter bore is no greater than the predetermined width of the annular sealing face 66 and, in the specific examples shown, is less than the predetermined width. With the circumferential sealing surface 70 being spherical the sealing contact with the inner peripheral surface 48 of the counterbore is only a line. The seal rings 62 each also include a biasing end 72 opposite of the sealing end 64. Although any suitable material may be used, in this application the seal rings are made from SAE 52100 through hardenable steel and are direct hardened by quenching from a suitable temperature and then tempering.

A means 74 for urging the seal toward the barrel plate 52 is disposed in each of the counterbores between the biasing end 72 of the seal ring 62 and the shoulder 50 of the counterbore 46. The means 74 for urging is a resilient member 76 which in this application comprises an annular metallic spring 78. The annular metallic spring 78 includes a generally flat base plate 80 having a plurality of resilient fingers 82 extending angularly therefrom. In this case, each of the resilient fingers 82 are integral with the base plate 80 and are bent outwardly at a juncture 83 therewith to extend angularly therefrom to a free end 84. Although it is recognized that the annular metallic spring may be placed loosely in the counterbores 48 beneath the seal rings 62, in this application the annular metallic springs are attached to the seal ring 62 by a plurality of spot welds 85. It is also recognized that the annular metallic spring 78 may be attached to the seal rings 62 in any suitable manner such as by adhesive bonding, brazing, etc. It is further recognized that other means for urging the seal rings, such as elastomeric rings, bellville washers or wave springs, may be used to urge the seal rings 62 into sealing engagement with the barrel plate 52. The annular metallic springs 78, as specifically taught in this application, may be formed from any suitable spring steel such as stainless steel.

A plurality of pistons 86 are individually, reciprocally disposed in the cylinder bores 42 of the barrel 36. The pistons individually include a pumping end 88 and a mounting end 90. The mounting end 90 comprises a spherical ball member 92 to which are attached an equal number of slipper bearings 94. As best seen in FIG. 1, the slipper bearings 94 are adapted for sliding contact with the inclined cam surface 28 of the housing 12. The slipper bearings 94 each also include a radial flange 96 at the end contacting the cam surface 28.

A part spherical abutment member 98 is slidingly attached to the shaft 32 in generally radial alignment with the cam surface 28 and for rotation with the shaft by any suitable means, such as a conventional key and keyway, indicated generally at 100. A holddown plate 102, having a spherical mounting surface 103, is pivotally supported on the spherical abutment member 98. The holddown plate 10 includes a plurality of bores 104. The bores 104 are disposed in telescopic engagement over the slipper bearings 94 with the plate 102 disposed in facing engagement with the flanges 96 on the side thereof opposite the cam surface 28. A means 105 comprising a plurality of springs, one of which is shown at 106, is disposed in biasing relation between the spherical abutment 98 and the barrel 36. This is effective to urge the spherical abutment member and the holddown plate downwardly, as viewed in FIG. 1, against the slipper bearings 9 for biased sliding engagement thereof with the cam surface 28.

Even though the lower portion of the fluid translating unit 10 as shown in FIG. 1 is broken away, it is recognized that the shaft 32 may be rotatably supported in any suitable manner with respect to the housing 12. In this particular application, although not shown, a double row tapered roller bearing is provided for such rotary support of the shaft.

Figure 6:
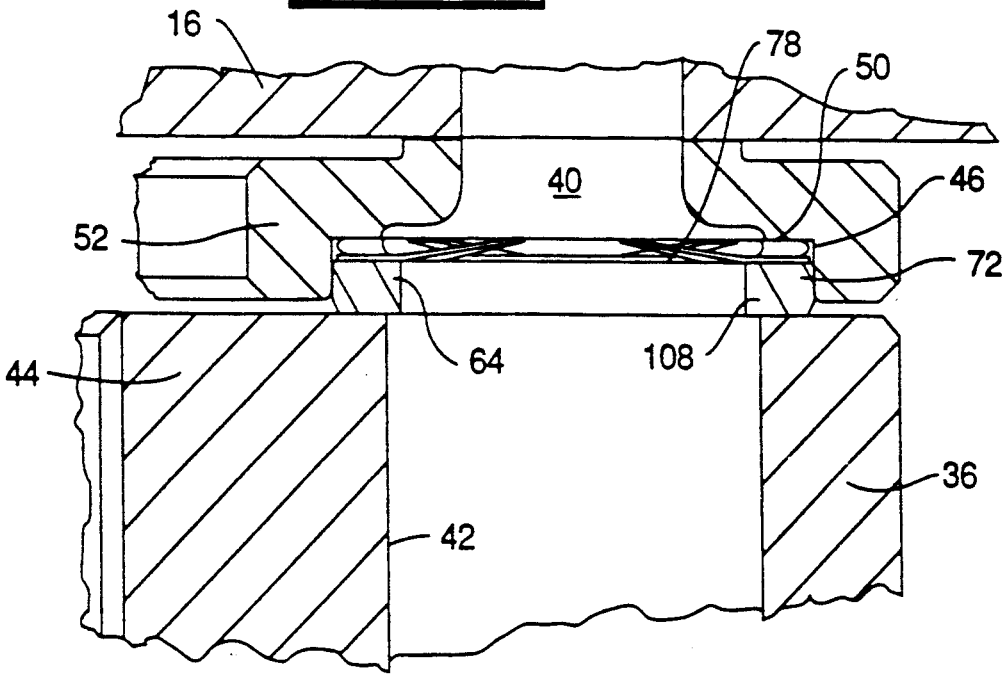
FIG. 6 is a fragmentary enlarged cross sectional view similar to FIG. 3 but showing an alternate embodiment of the present invention.

FIG. 6 discloses an alternate embodiment of the present invention with similar elements thereof being identified by the same reference numerals. In this embodiment, the counterbores 46 are provided in the barrel plate 52 in generally surrounding relation to the ports 58. The sealing end 64 of the seal ring 62 engages a sealing surface 108 defined on the intake-output end 44 of the barrel 36. In this embodiment the annular metallic spring 78 is disposed above the seal ring 62, as viewed in FIG. 6, between the biasing end 72 of the seal ring and the shoulder 50 in the barrel plate 52.

Figure 7:
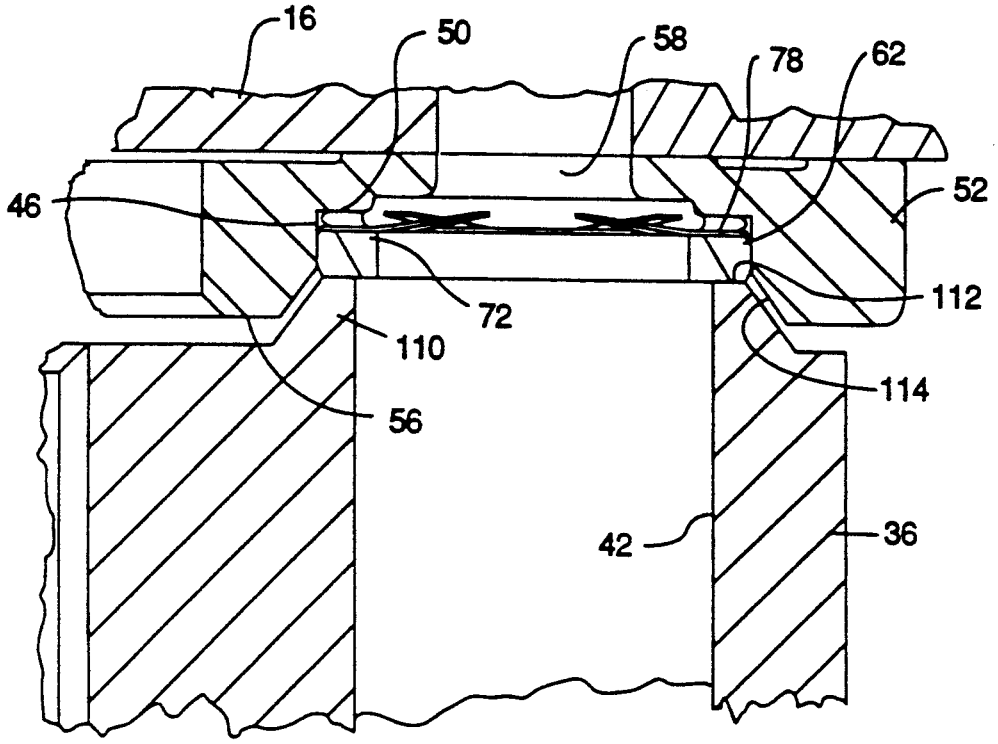
FIG. 7 is a fragmentary enlarged cross sectional view similar to FIG. 6 but disclosing another alternate embodiment of the present invention.

FIG. 7 discloses yet another embodiment of the present invention. In this embodiment, the barrel 36 includes a plurality of annular protrusions 110 of a predetermined length which are individually disposed around each of the cylinder bores 42 and define therewith a face sealing surface 112. Although the annular protrusions 110 may be of any suitable configuration, they are shown in this specific example as being frustoconical in shape. The barrel plate 52 further defines a plurality of recesses 114, each extending from one of the counterbores 46 to the second annular surface 56 of the barrel plate. Each of the recesses 114 has a predetermined depth which, with respect to the length of the protrusions 110, is sufficient to maintain the axially spaced relation of the second annular surface 56 with respect to the intake-output end 44 of the barrel 36. In like manner to the protrusions, the recesses 114 are depicted as being frustoconical in form. In this embodiment the annular metallic spring 78 is disposed above the seal ring 62, as viewed in FIG. 7, between the biasing end 72 of the seal ring and the shoulder 50 in the barrel plate 52.

Figure 8:
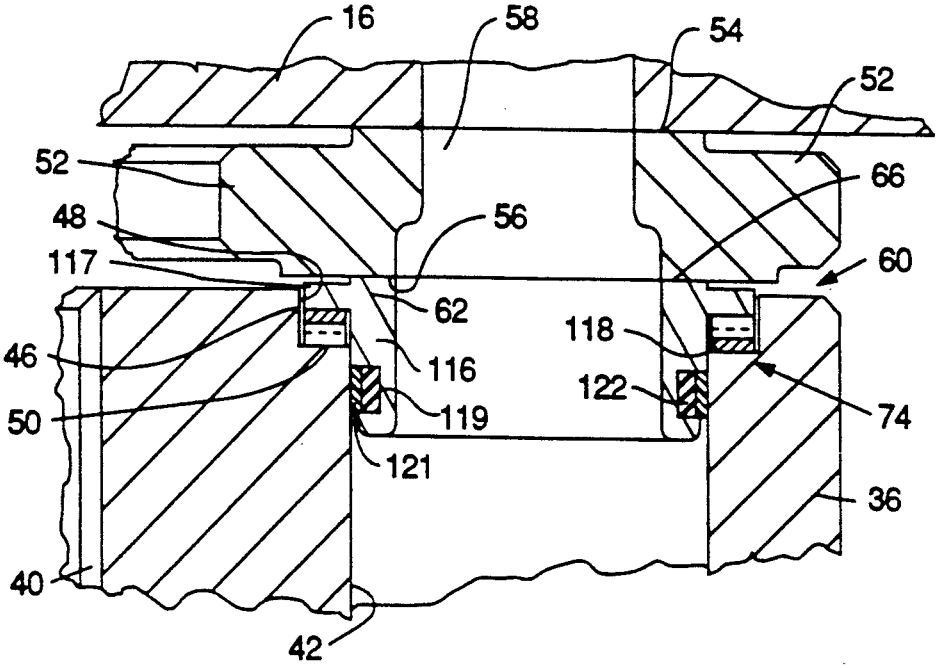
FIG. 8 is a fragmentary enlarged cross sectional view similar to FIG. 3 but showing another alternate embodiment of the present invention.

FIG. 8 discloses still another embodiment of the present invention. In this embodiment, the seal ring 62 has a cylindrical portion 116 loosely disposed within the cylinder bore 42, an annular flange 117 extending radially outwardly into the counterbore 46, and an annular seal face 66 in sealing contact with the the annular surface 56. The means 74 for urging the seal face 66 against the annular surface 56 comprises an annular wave spring 118 interposed the flange 117 and the shoulder 50 of the counterbore 46. A radially outwardly facing annular groove 119 is formed in the cylindrical portion 116 and contains a pair of coaxially disposed annular seals 121 and 122. The seal 121 is preferably made from a low friction plastic material having sufficient stiffness to resist being extruded between the cylindrical portion and the cylinder bore by the hydraulic pressure in the cylinder bore. The seal 122 is preferably made from an elastomeric material sufficient for urging the seal 121 into sealing contact with the cylinder bore.

Although the axial piston fluid translating unit of the present invention is disclosed as being of the in-line or cantilevered design, it is recognized that the present invention is also applicable to fluid translating units of the bent axis or link type while providing the same advantages.

The present invention is disclosed in the instant application as applied to a fluid translating unit wherein the barrel plate ports 58 and the intake and output ports 20, 22 are axially aligned with the cylinder bores 42. It should be recognized that the present invention is equally applicable to axial piston fluid translating unit having radially inset porting which is provided, in some instances, for improved filling of the cylinder bores 42 as the pistons are retracted therein.

INDUSTRIAL APPLICABILITY

In the use of the present invention, rotation of the barrel 36 in conjunction with the shaft 32 causes reciprocation of the pistons 86 within the cylinder bores 42 as the slipper pads 94 follow the inclined cam surface 28 of the housing 12. When used as a pump as the pistons 86 move upward in the cylinder bores 42, fluid is pumped through the ports 58 of the barrel plate and the output port 22 of the head 16. Simultaneously therewith as others of the pistons 86 are retracting, fluid is drawn in through the intake port 20 to fill the cylinder bores 42 for a subsequent pumping operation as previously described. During this operation, the forces acting on the barrel resulting from the slipper pads 94 traversing the inclined cam surface 28 and the radial forces generated from the pistons being in different planes may cause deflection of the shaft 32. Such deflection can cause the barrel 36 to move or tilt with respect to the porting surface 18. Since the barrel plate 52 is not connected to the shaft 32, deflection thereof does not generate any tilting forces on the barrel plate thus allowing it to remain parallel and in effective face sealing engagement with the porting surface 18 of the head 16. The provision of the seal means 60 permits limited tilting of the barrel without causing separation and loss of sealing engagement with the second annular surface of the barrel plate 52. The relatively short circumferential engagement of the circumferential sealing surface 70 of the seal rings 62 with the inner peripheral surface 48 of the counterbores 46 results in minimal restriction to tilting and/or sliding of the seal rings in the counterbores. As a result, the seal rings 62 maintain face sealing engagement with the second annular surface 56 of the barrel plate 52 or the sealing surface 108, 110 on the end of the barrel when the barrel is tilted as herein before described.

When the fluid translating unit 10 is used as a motor the barrel plate and sealing means of the present invention operates in a similar manner to that as utilized in a pump. For example, as pressurized fluid is introduced to the cylinder bores 42 by way of the intake port 20 the pistons 86 are forced inwardly with the slipper bearings 94 moving down the inclined cam surface 28 thus imparting rotation to the barrel 36 and the shaft 32. In this application, the barrel plate 52 and the seal means 60 operate to permit limited tilting of the barrel relative to the barrel plate 52 without loss of fluid sealing and/or contact between the relatively rotatable surfaces as herein before described.

Other aspects, objects and advantages of this invention can be obtained from a study of the drawings, the disclosure, and the appended claims.

We claim:

1. An axial piston fluid translating unit including a housing having an intake port and an output port each terminating at one end at a porting surface in the housing, a rotatable shaft extending into the housing, a cylinder barrel disposed in the housing and supported for rotation with the shaft and having a fluid intake-output end and defining a plurality of cylinder bores, a plurality of pistons reciprocally disposed in the cylinder bores, the intake-output end of the barrel is disposed in proximate facing relation to the porting surface of the housing, comprising:

an axially floating barrel plate disposed between the housing porting surface and the intake-output end of the barrel and being connected for rotation with the barrel in axially spaced relation to the intake-output end thereof, the barrel plate having a first annular surface in face sealing engagement with the porting surface and a plurality of fluid ports each communicating between one of the cylinder bores and the housing porting surface for sequential communication with the intake and output ports, a plurality of counterbores defined in the barrel in generally surrounding relation to the fluid ports, seal means interposed between the barrel and barrel plate in sealing relation around each cylinder bore, the seal means including a plurality of annular seal rings each having a sealing end defining an annular seal face, the annular seal rings being disposed one in each of the counterbores in face sealing relation to the barrel plate, and means for urging the seal rings toward the barrel plate, the means for urging the seal rings comprising a resilient member disposed in the respective counterbores.

2. The axial piston fluid translating unit of claim 1 wherein the resilient member comprises an annular metallic spring.

3. The axial piston fluid translating unit of claim 2 wherein each of the seal rings has an annular seal face having a predetermined width and an outer periphery defining a circumferential sealing surface thereon, the annular seal rings being disposed one in each of the counterbores in circumferential sealing relation of a predetermined length thereto, the predetermined length of sealing relation between the circumferential sealing surface and the counterbore being no greater than the predetermined width of the annular sealing face.

4. The axial piston fluid translating unit of claim 2 wherein each of the seal rings has a cylindrical portion extending into the associated cylinder bore and an annular flange extending radially outwardly into the associated counterbore, the annular spring being interposed between the flange and the barrel.

5. The axial piston fluid translating unit of claim 2 wherein the annular metallic spring includes a generally annular flat base plate having a plurality of resilient fingers extending angularly therefrom.

6. The axial piston fluid translating unit of claim 5, wherein the annular base plate of the metallic spring is secured to the seal ring.

7. The axial piston fluid translating unit of claim 1 wherein the resilient member comprises an annular metallic spring.

8. The axial piston fluid translating unit of claim 7, wherein the barrel includes a face sealing surface in generally surrounding relation to the fluid ports in the barrel plate.

9. The axial piston fluid translating unit of claim 8 wherein the intake-output end of the barrel includes an annular protrusion of a predetermined length disposed around each of the cylinder bores and defining the face sealing surface.

10. The axial piston fluid translating unit of claim 9 wherein the barrel plate includes a second annular surface disposed in facing axially spaced relation to the intake-output end of the barrel and defines a recess extending from each of the counterbores to the second annular surface with each of the recesses being of a depth with respect to the length of the protrusions sufficient to maintain the axially spaced relation of the second annular surface with respect to the intake-output end of the barrel.

11. An axial piston fluid translating unit including a housing having an intake port and an output port each terminating at one end at a porting surface in the housing, a rotatable shaft extending into the housing, a cylinder barrel disposed in the housing and supported for rotation with the shaft and having a fluid intake-output end and defining a plurality of cylinder bores, a plurality of pistons reciprocally disposed in the cylinder bores, the intake-output end of the barrel is disposed in proximate facing relation to the porting surface of the housing, comprising:

an axially floating barrel plate disposed between the housing porting surface and the intake-output end of the barrel and being connected for rotation with the barrel in axially spaced relation to the intake-output end thereof, the barrel plate having a first annular surface in face sealing engagement with the porting surface and a plurality of fluid ports each communicating between one of the cylinder bores and the housing porting surface for sequential communication with the intake and output ports, a plurality of counterbores defined in the barrel plate in generally surrounding relation to the fluid ports, seal means interposed between the barrel and the barrel plate in sealing relation around each cylinder bore, the seal means including a plurality of annular seal rings each having a sealing end defining an annular seal face, the annular seal rings being disposed one in each of the counterbores in face sealing relation to the barrel, and means for urging the seal rings toward the means for urging the seal rings comprising a resilient member disposed in the respective counterbores.

* * * * *